US005358182A

United States Patent [19]

Cappeau et al.

[11] Patent Number: 5,358,182

[45] Date of Patent: Oct. 25, 1994

[54] DEVICE WITH ROTATING ATOMIZER HEAD FOR ELECTROSTATICALLY SPRAYING LIQUID COATING PRODUCT

[75] Inventors: Michel Cappeau, Sassenage; Laurent Turc, Grenoble, both of France

[73] Assignee: Sames S.A., Meylan, France

[21] Appl. No.: 75,095

[22] Filed: Jun. 11, 1993

[30] Foreign Application Priority Data

Jun. 22, 1992 [FR] France ..... 92 07559

[51] Int. Cl.[5] ..... B05B 5/04

[52] U.S. Cl. ..... 239/703; 239/112; 239/224

[58] Field of Search ..... 239/223–225, 239/700, 112, 73, 7, 766, 707, 703

[56] References Cited

U.S. PATENT DOCUMENTS

| | | | |
|---|---|---|---|
| 4,572,437 | 2/1986 | Huber et al. | 239/700 X |
| 4,605,168 | 8/1980 | Tachi et al. | 239/112 |
| 4,852,810 | 8/1989 | Behr | 239/703 |
| 4,936,509 | 6/1990 | Weinstein | 239/112 X |
| 5,106,025 | 4/1992 | Giroux et al. | 239/112 X |

FOREIGN PATENT DOCUMENTS

| | | | |
|---|---|---|---|
| 0120648 | 10/1984 | European Pat. Off. . | |
| 186342 | 7/1986 | European Pat. Off. | 239/700 |
| 0379373 | 7/1990 | European Pat. Off. . | |
| 3241504 | 4/1984 | Fed. Rep. of Germany | 239/700 |
| 1190533 | 10/1959 | France . | |
| 1360743 | 2/1963 | France | 239/703 |
| 8810152 | 12/1988 | PCT Int'l Appl. . | |

*Primary Examiner*—Andres Kashnikow
*Assistant Examiner*—Kevin Weldon
*Attorney, Agent, or Firm*—Spensley Horn Jubas & Lubitz

[57] ABSTRACT

A device for electrostatically spraying coating product has a rotating insulative material atomizer head and an axial charging electrode adapted to be connected to a high voltage supply and projecting to the front of the atomizer head to charge the atomized coating product by ionic bombardment.

16 Claims, 1 Drawing Sheet

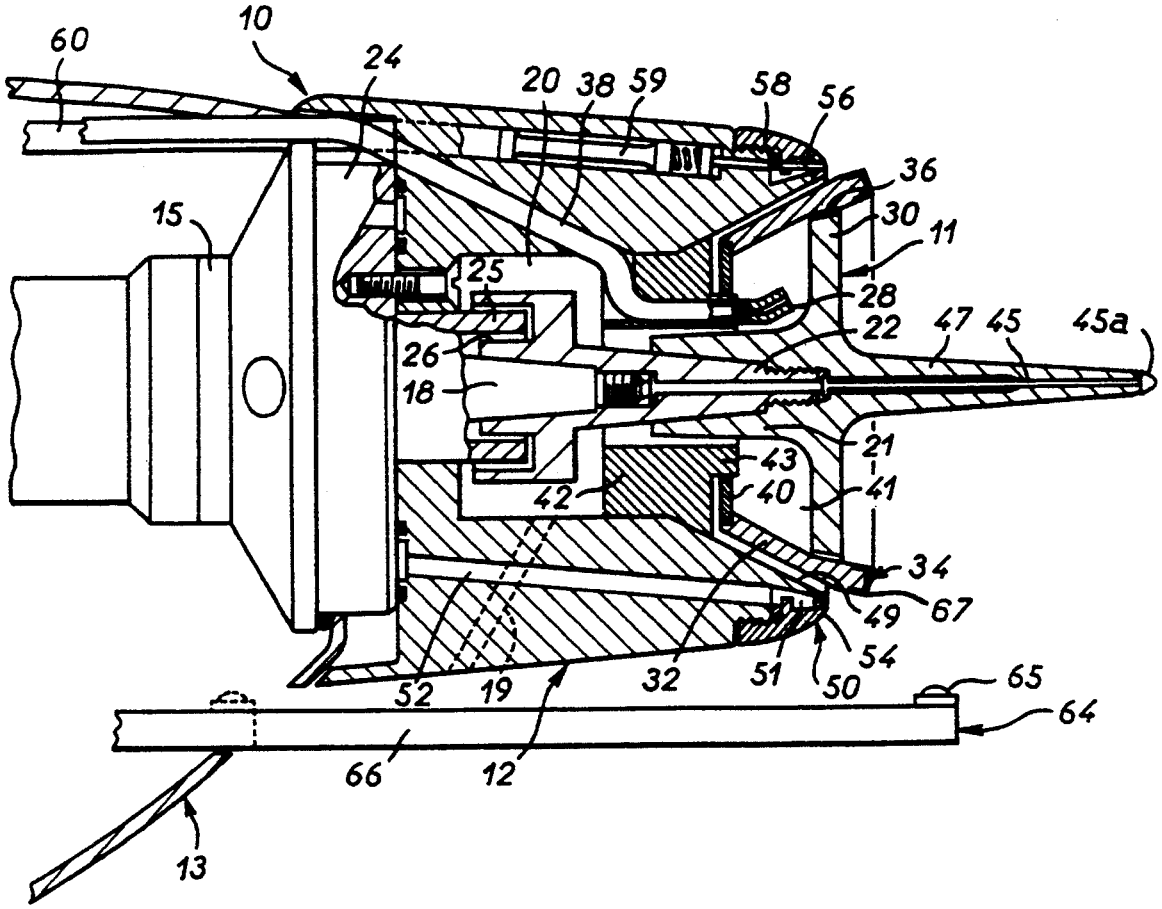
60
10
24
20
38
59
58
56
36
30
11
15
25
28
22
47
45
45a
26
18
21
43
40
41
42
34
67
49
54
52
19
32
51
50
65
64
66
12
13

DEVICE WITH ROTATING ATOMIZER HEAD FOR ELECTROSTATICALLY SPRAYING LIQUID COATING PRODUCT

BACKGROUND OF THE INVENTION

1. Field of the invention

The invention concerns a device for electrostatically spraying liquid coating products such as paint of the type having a rotating atomizer head comprising an approximately bowl-shaped part having an annular atomizer edge at which the coating product is atomized by centrifugal force.

The invention is more particularly concerned with means for electrostatically charging the atomized coating product by ionic bombardment.

2. Description of the Prior Art

It is known in electrostatic sprayer devices to have the liquid coating product in contact with a high voltage electrode at the atomizer to charge the liquid before it is atomized. The electrically charged and atomized liquid carries electrical charges with it when it leaves the atomizer to travel towards the object to be coated. This method of charging is of limited efficiency if the liquid is highly insulative because it can then acquire only a low electrical charge through contact with a high voltage electrode. If the liquid is conductive the feed circuit for the liquid coating product, which is grounded, can short-circuit the high voltage generator. The solution to this is to insulate the coating product feed electrically from ground, for example by using an intermediate storage tank insulated from ground and therefore connectable to the high voltage.

It is also known to charge atomized particles in the air by ionic bombardment. In this method the coating product droplets are charged as they pass between the sprayer device and the object to be coated. The bombardment coating method generates atmospheric ions near a high voltage electrode by virtue of the corona effect. These ions are caused to move in the electric field produced between the electrode and a counter-electrode at a different potential. The counter-electrode is often the object to be coated, which is grounded. For highly insulative liquids this method of charging by bombardment is more appropriate than charging by means of an electrode. It is also advantageous for conductive and even highly conductive liquids because it is no longer necessary to insulate the coating product feed electrically from ground potential. This greatly simplifies the circuits feeding the electrostatic sprayer device.

A sprayer device of this kind is described in U.S. Pat. No. 4,852,810, for example, which discloses a system comprising a rotating atomizer head which is grounded and a large number of external electrodes disposed in an annular member of relatively large diameter surrounding the rotating atomizer head. These electrodes are at the high voltage.

A system of this kind has many drawbacks. It is relatively large overall and is easily soiled. The proportion of the current contributing effectively to the charging of the coating product droplets is relatively small because a large proportion is captured by the atomizer itself, in other words, the high voltage generator must supply a very high current. The charge on the coating product droplets depends greatly on the ionization conditions between the electrodes and the object to be coated. It depends also on the geometry of the object (in particular whether it has edges, especially sharp edges) and on the distance between the electrodes and the object to be coated. It depends further on the relative humidity in the area in which the coating product is applied. The charge on the coating product droplets depends additionally on the area over which the atomized liquid impacts on it. The efficiency of deposition is low. Finally, the electrical capacitance of the charging electrodes is high, which increases the risk of electrical arcing.

The invention proposes a rotating atomizer head sprayer device provided with ionic bombardment charging means enabling the above-mentioned drawbacks to be eliminated or reduced.

SUMMARY OF THE INVENTION

The present invention consists in a device for electrostatically spraying liquid coating product comprising a rotating head for atomizing said coating product made from an insulative material and comprising an axial charging electrode adapted to be connected to a high voltage supply and projecting in front of said atomizer head for charging the atomized liquid by ionic bombardment.

The atomizer head may be made from a material such as polyamide, polyoxymethylene, polyethylene teraphtalate, polytetrafluoroethylene or other similar materials, this list being by no means exhaustive.

The atomizer head advantageously comprises an axial extension in the same insulative material and in the direction in which the coating product is atomized, that is towards the object to be coated. This extension has a longitudinal opening in it and houses the aforementioned charging electrode of which only an ionizing end projects beyond said axial extension. The optimal length of this axial extension determines the distance between the ionizing end of the electrode and the atomizer edge of the rotating head and depends on the nature of the coating product to be atomized and in particular on its conductivity. For example, with a 70 mm diameter (at the atomizer edge) atomizer head the axial extension would be between 50 and 75 mm long for a conductive liquid. It could be shorter (or even dispensed with entirely) in the case of atomizing an insulative liquid.

The invention will be better understood and other advantages of the invention will emerge more clearly from the following description of a sprayer device in accordance with the invention given by way of non-limiting example only with reference to the appended drawing.

BRIEF DESCRIPTION OF THE DRAWING

The single figure shows, partially in cross-section, an electrostatic sprayer device comprising a rotating atomizer head and means for charging the atomized liquid by ionic bombardment.

DETAILED DESCRIPTION OF THE INVENTION

The electrostatic sprayer device 10 shown comprises an insulative material rotating atomizer head 11 and an insulative material support 12 disposed at the end of a casing 13 enclosing a turbine 15 driven by compressed air, for example. At least the shaft 18 of the turbine is made from a conductive material and adapted to be connected to a high voltage supply. In this example all of the turbine is at the high voltage. The insulative material support 12 has a central cavity in which the shaft of the turbine is inserted. In this example the device is specifically intended to atomize a conductive coating product. The insulative material rotating atomizer head 11 comprises a hub 21 mounted on an insulative material extender 22 in turn mounted on the shaft 18 of the turbine. The insulative material flange 24 of the turbine is fixed to the support 12 and comprises an internal sleeve 25 inserted without contacting it into an annular groove 26 on the extender in order to form, all around the shaft 18 at the high voltage, "chicanes" to increase the insulative path between the shaft 18 and the liquid coating product feed circuit which in this example is conductive and grounded. It terminates at a feed nozzle 28 directed towards a radial wall of the rotating atomizer head 11.

To go into more detail, said atomizer head comprises a flange 30 substantially perpendicular to its rotation axis fastened to the hub 21 and a frustoconical or bowl-shaped part 32 whose outer edge constitutes the atomizer edge 34 at which the liquid coating product is atomized by centrifugal force to form fine droplets. The feed nozzle 28 faces the inside wall of the flange 30 and equi-angularly distributed holes 36 pass through said flange near where it merges with the bowl-shaped part 32. The liquid to be sprayed is fed through the pipe 38 passing through the support 12 and ejected by the nozzle 28 onto the inside surface of the flange 30. It is then fed by centrifugal force to the holes 36 and then along the inside surface of the bowl-shaped member 32 as far as the atomizer edge 34.

The sprayer head 11 further comprises a rear annular wall 40 which is disposed radially to close the rear cavity 41 in which the nozzle 28 is engaged at least partially (as well as possible). To this end the support 12 comprises an annular core 42 closing the cavity 20 and surrounding the hub of the atomizer head. The cavity 20 is vented through a hole 19 in the support 12. The core has an extension 43 engaged in the rear cavity 41 of the atomizer head without touching the hub 21. Said rear annular wall 40 of the atomizer head extends to the vicinity of the outside wall of the extension 43 and the coating product feed nozzle is mounted at the end of this extension. A cleaning product feed nozzle (not visible in the drawing) is similarly mounted. This arrangement avoids splashing of coating product and cleaning product to the rear of the atomizer head.

According to an important feature of the invention the insulative material atomizer head 11 comprises an axial charging electrode 45 adapted to be connected to the high voltage supply and projecting to the front of the atomizer head 11. This electrode is mounted in alignment with and is in electrical contact with the metal shaft 18 of the turbine 15.

This example is more suited to atomizing a conductive liquid coating product and the atomizer head therefore comprises an axial extension 47 of the same insulative material in the direction in which the atomized liquid product is sprayed, that is towards the object to be coated. It incorporates a longitudinal hole for housing the charging electrode. The extension 47 is in one piece with the flange 30. Only an ionizing end **45*a* of the electrode projects beyond the axial extension of the atomizer head. As shown, this ionizing end 45*a*** is enlarged and shaped to protect the insulative material at the end of the axial extension.

In this example the ionizing end **45*a* is substantially conical in shape, i.e. it has a circular sharp edge "oriented" towards the atomizer edge 34 of the rotating atomizer head. This edge is disposed so that the corona discharge does not contact the insulative material of said axial extension 47. The end of the axial extension could instead be metal-plated or covered with conductive material to protect the insulative material. Also, as shown, the approximately bowl-shaped part 32 of the atomizer head is virtually entirely housed within an open cavity 49 in the support 12 which therefore has a front annular end 50 near the atomizer edge 34** but set back in the axial direction relative to it (in other words to the rear, taking the direction in which the atomized jet propagates as the reference).

This annular end 50 comprises an annular chamber 51 connected by a pipe 52 to compressed air supply means. Equi-angularly distributed air ejector passages 54 communicate at their inner end with the chamber 51 and discharge at their outer end in the direction in which the coating product is sprayed all around the atomizer edge of the rotating head in order to propel the atomized product towards the product to be coated. Likewise, the support 12 carries one or more counter-electrodes 56 which are in the form of spikes in this example, connected to a conductive ring 58 in turn connected by a resistor 59 (accommodated in a cavity in the fixed support) to an electrically insulated conductor 60. The electrodes 56 are flush with the annular end 50 of the support 12 or slightly set back from it. The annular end 50 is itself set back in the axial direction relative to the atomizer edge 34. The electrodes are thus electrically connected to a potential different than that at the charging electrode, ground potential, for example. The electrodes could instead be in the form of small balls or replaced by a ring.

Finally, the system is completed by external cleaning liquid spray means 64 comprising a flat jet spray nozzle 65 mounted at the end of a support 66 mobile parallel to the rotation axis of the atomizer head. The support 66 is moved by a small piston-and-cylinder actuator (not shown). In the position shown in the drawing the nozzle 65 is in the cleaning position, forward of the atomizer edge 34 of the rotating head, i.e. in position for cleaning the flange 30, the atomizer edge 34, the axial extension 47 and the ionizing end **45*a* of the charging electrode. The plane of the jet passes substantially through the rotation axis of the atomizer head. When the cleaning liquid spray means are not in use the mobile support 66 is withdrawn into the housing 13 to the rear of the support 12**, as shown in dashed outline.

In operation the liquid coating product is deposited onto the inside surface of the flange 30 and centrifugal force causes it to flow in a thin film to the atomizer edge 34 at which it forms jets which are atomized into fine droplets. As this is a relatively good conductor liquid from a distribution circuit that is grounded, an electric field is established between the ionizing end **45*a* of the axial electrode 45 and the atomizer edge 34 which forms a sort of counter-electrode at ground potential. The path of the atmosphere ions emitted by the charging electrode intersects the path of the fine droplets which have just formed. The liquid droplets are thus charged in the air in front of the atomizer edge 34. It is thought that the electrodes 56 favorably deform the field near the atomizer edge 34** and so increase the time for which the coating product droplets pass through a high electric field. A small proportion of the ions emitted by the charging electrode is directed towards the object to be coated, which is grounded. These ions also bombard the atomized coating product droplets, which increases the electrical charge on the droplets.

An insulative coating product is ionized between the charging electrodes and the object to be coated. This is why the axial extension may be shorter or even dispensed with, the electrode being near the flange in this latter case. The peripheral electrodes 56 may also be dispensed with in this case.

Other embodiments are feasible. Specifically, a damper resistor may be provided between the shaft 18 and the electrode 18, inside the extender 22, for example.

The electrodes 56 may with advantage be disposed in air ejector passages. They are then swept at all times by a flow of air.

Advantageously, it is possible to reinforce the atomizer head 11 against Corona effect, in the vicinity of the atomizer edge 34. As shown, an annular area 67 including said atomizer edge 34 is covered of a Corona effect resisting material such as, for instance a metallic layer or a ceramic layer. This layer may be an annular member mounted on the atomizer head.

There is claimed:

1. Device for electrostatically spraying liquid coating product comprising a rotating head for atomizing the coating product, said rotating head being made from an insulative material and comprising an axial charging electrode adapted to be connected to a high voltage supply and projecting in front of said atomizer head for charging the atomized liquid coating product by ionic bombardment.

2. Sprayer device according to claim 1 wherein said atomizer head comprises an insulative material axial extension in the direction towards the object to be coated with a longitudinal hole in it housing said charging electrode of which an ionizing end projects beyond said axial extension.

3. Sprayer device according to claim 2 wherein said ionizing end is enlarged to protect the insulative material of said axial extension.

4. Sprayer device according to claim 2 wherein said ionizing end has a sharp circular edge.

5. Sprayer device according to claim 1 wherein said atomizer head is fixed to the end of a shaft of a turbine, at least said shaft is made from a conductive material and adapted to be connected to a high voltage supply and said charging electrode is axially aligned with said shaft and is electrically connected thereto.

6. Sprayer device according to claim 1 further comprising an insulating material support having a cavity, and wherein said atomizer head has a part whose exterior is at least approximately bowl-shaped and is substantially located in said cavity.

7. Sprayer device according to claim 6 wherein said atomizer head comprises a substantially radial flange with equi-angularly distributed holes through it, a coating product feed nozzle carried by said support is engaged in a rear cavity of said atomizer head so that its orifice is facing said flange and said atomizer head comprises a rear annular wall extending radially to close said rear cavity at least partially.

8. Sprayer device according to claim 7 wherein said support comprises an extension around a hub of said atomizer head and engaged in said rear cavity, said rear annular wall extends to the vicinity of the outside wall of said extension and said feed nozzle is mounted at the end of said extension.

9. Sprayer device according to claim 6 wherein said support has an annular front end set back axially relative to an annular atomizer edge of said atomizer head and said annular front end comprises air ejector means discharging externally in the direction in which the coating product is sprayed all around said atomizer edge of said atomizer head.

10. Sprayer device according to claim 6 wherein said insulative material support carries at least one electrode disposed in the vicinity of an annular atomizer edge of said atomizer head and set back axially relative thereto and said electrode is electrically connected to a potential different than that of said charging electrode.

11. Sprayer device according to claim 10 comprising a plurality of the aforementioned electrodes optionally in the form of equi-angularly distributed spikes.

12. Sprayer device according to claim 10 wherein said at least one electrode is ring-shaped.

13. Sprayer device according to claim 10 wherein said at least one electrode is located within an air ejector passage.

14. Sprayer device according to claim 10 wherein said at least one electrode is adapted to be connected to a potential via a resistor.

15. Sprayer device according to claim 2 comprising cleaning liquid spray means having a flat jet spray nozzle mounted at the end of a support mobile parallel to the rotation axis of said atomizer head.

16. Sprayer device according to claim 1 wherein said atomizer head comprises an annular area in the vicinity of an atomizer edge, covered by a Corona effect resisting material.

* * * * *